US006059012A

United States Patent [19]

Vining et al.

[11] Patent Number: 6,059,012

[45] Date of Patent: May 9, 2000

[54] THERMAL SHOCK RESISTANT APPARATUS FOR MOLDING THIXOTROPIC MATERIALS

[75] Inventors: Ralph Vining, Fort Wayne, Ind.; Raymond F. Decker, Ann Arbor, Mich.; Robert D. Carnahan, Park City, Utah; D. Matthew Walukas, Ypsilanti, Mich.; Robert Kilbert, Racine, Wis.; Charles VanSchilt, Calgary, Canada; Rich Newman, Gladwin, Mich.

[73] Assignee: Thixomat, Inc., Ann Arbor, Mich.

[21] Appl. No.: 09/325,269

[22] Filed: Jun. 3, 1999

Related U.S. Application Data

[62] Division of application No. 08/940,631, Sep. 30, 1997.

[51] Int. Cl.[7] ..... B22D 17/00

[52] U.S. Cl. ..... 164/312; 164/900; 425/205; 366/78; 366/79

[58] Field of Search ..... 164/900, 312, 164/113; 425/205; 366/78, 79, 83, 146

[56] References Cited

U.S. PATENT DOCUMENTS 5,040,589 8/1991 Bradley et al. ..... 164/900

5,501,266 3/1996 Wang et al. ..... 164/900

FOREIGN PATENT DOCUMENTS 5-285626 11/1993 Japan ..... 164/900

*Primary Examiner*—Kuang Y. Lin

*Attorney, Agent, or Firm*—Harness, Dickey & Pierce, P.L.C.

[57] ABSTRACT

An apparatus for processing feed stock into a thixotropic state. The apparatus includes a barrel with first, second and nozzle sections. The first, second and nozzle sections are connected together and include surfaces that cooperatively defining a central passageway through the barrel. The first section is constructed of a first material, the second end section is constructed of a second material and the nozzle is constructed of a third material. The first material exhibits a greater resistance to thermal fatigue and thermal shock than the second material while the nozzle section includes a bushing which inhibits heat transfer to the die, precluding excessive molding pressures and cycle times. The apparatus also includes a preheater for preheating the feed stock before entry into the barrel, a thermal gradient monitoring system, a novel robust nozzle construction, and a two-stage embodiment of the apparatus.

23 Claims, 3 Drawing Sheets

THERMAL SHOCK RESISTANT APPARATUS FOR MOLDING THIXOTROPIC MATERIALS

This is a division of U.S. patent application Ser. No. 08/940,631, filed Sep. 30, 1997.

BACKGROUND OF THE INVENTION

1. Field of the Invention

This invention relates to an apparatus for molding thixotropic materials into articles of manufacture. More specifically, the present invention relates to a thermally efficient and thermally shock resistant apparatus for molding thixotropic materials into articles of manufacture.

2. Description of the Prior Art

Metal compositions having dendritic structures at ambient temperatures conventionally have been melted and then subjected to high pressure die casting procedures. These conventional die casting procedures are limited in that they suffer from porosity, melt loss, contamination, excessive scrap, high energy consumption, lengthy duty cycles, limited die life, and restricted die configurations. Furthermore, conventional processing promotes formation of a variety of microstructural defects, such as porosity, that require subsequent, secondary processing of the articles and also result in use of conservative engineering designs with respect to mechanical properties.

Processes are known for forming these metal compositions such that their microstructures, when in the semi-solid state, consist of rounded or spherical, degenerate dendritic particles surrounded by a continuous liquid phase. This is opposed to the classical equilibrium microstructure of dendrites surrounded by a continuous liquid phase. These new structures exhibit non-Newtonian viscosity, an inverse relationship between viscosity and rate of shear, and the materials themselves are known as thixotropic materials.

One process for forming thixotropic materials requires the heating of the metal composition or alloy to a temperature which is above its liquidus temperature and then subjecting the liquid metal alloy to a high shear rate as it is cooled into the region of two phase equilibria. A result of the agitation during cooling is that the initially solidified phases of the alloy nucleate and grow as rounded primary particles (as opposed to interconnected dendritic particles). These primary solids are comprised of discrete, degenerate dendritic spherules and are surrounded by a matrix of an unsolidified portion of the liquid metal or alloy.

Another method for forming thixotropic materials involves the heating of the metal composition or alloy (hereafter just "alloy") to a temperature at which most, but not all of the alloy is in a liquid state. The alloy is then transferred to a temperature controlled zone and subjected to shear. The agitation resulting from the shearing action of the material converts any dendritic particles into degenerate dendritic spherules. In this method, it is preferred that when initiating agitation, the semisolid metal contain more liquid phase than solid phase.

An injection molding technique using alloys delivered in an "as cast" state has also been seen. With this technique, the feed material is fed into a reciprocating screw injection unit where it is externally heated and mechanically sheared by the action of a rotating screw. As the material is processed by the screw, it is moved forward within the barrel. The combination of partial melting and simultaneous shearing produces a slurry of the alloy containing discrete degenerate dendritic spherical particles, or in other words, a semisolid state of the material and exhibiting thixotropic properties. The thixotropic slurry is delivered by the screw to an accumulation zone in the barrel which is located between the extruder nozzle and the screw tip. As the slurry is delivered into this accumulation zone, the screw is simultaneously withdrawn in a direction away from the unit's nozzle to control the amount of slurry corresponding to a shot and to limit the pressure build-up between the nozzle and the screw tip. The slurry is prevented from leaking or drooling from the nozzle tip by controlled solidification of a solid metal plug in the nozzle and the plug is formed by controlling the nozzle temperature. Once the appropriate amount of slurry for the production of the article has been accumulated in the accumulation zone, the screw is rapidly driven forward developing sufficient pressure to force the solid metal plug out of the nozzle and into a receiver thereby allowing the slurry to be injected into the die cavity so as to form the desired solid article. The plug in the nozzle provides protection to the slurry from oxidation or the formation of oxide on the interior wall of the nozzle that would otherwise be carried into the finished, molded part. The plug further seals the die cavity on the injection side facilitating the use of vacuum to evacuate the die cavity and further enhance the complexity and quality of parts so molded. The plug further permits a faster cycle time than would otherwise be obtained if a sprue break operational mode was used. The receiver includes a sprue bushing that directs the flow of slurry into the die cavity and also thermally controls the solidification rate of the sprue in order to reduce cycle times and make the machine more efficient.

Currently, the thixotropic molding machines perform all of the heating of the material in the barrel of the machine. Material enters at one section of the barrel while at a "cold" temperature and is then advanced through a series of heating zones where the temperature of the material is rapidly and, at least initially, progressively raised. The heating elements themselves, typically resistance or induction heaters, of the respective zones may or may not be progressively hotter than the preceding heating elements. As a result, a thermal gradient exists both through the thickness of the barrel as well as along the length of the barrel.

Typical barrel constructions of a molding machine for thixotropic materials have seen the barrels formed as long (up to 110 inches) and thick (outside diameters of up to 11 inches with 3–4 inch thick walls) monolithic cylinders. As the size and through-put capacities of these machines have increased, the length and thicknesses of the barrels have correspondingly increased. This has led to increased thermal gradients throughout the barrels and previously unforseen and unanticipated consequences. Additionally, the primary material, wrought alloy 718 (having a limiting composition of: nickel (plus cobalt), 50.00–55.00%; chromium, 17.00–21.00%; iron, bal.; columbium (plus tantalum) 4.75–5.50%; molybdenum, 2.80–3.30%; titanium, 0.65–1.15%; aluminum, 0.20–0.80; cobalt, 1.00 max.; carbon, 0.08 max.; manganese, 0.35 max.; silicon, 0.35 max.; phosphorus, 0.015 max.; sulfur, 0.015 max.; boron, 0.006 max.; copper, 0.30 max. used in constructing these barrels is currently in severe short supply (12 month minimum lead time) and is extremely expensive ($12.00/lb). Two recently constructed 600 ton capacity barrels took one year to procure and cost $150,000 each.

After the lengthy time required for the acquisition of the alloy 718 construction material, the high cost involved in obtaining the construction material, and the time involved in fabricating the barrels themselves, the two 600 ton barrels were put into service molding thixotropic materials, specifically magnesium alloys. Within less than one week of service, approximately 700–900 cycles of the thixotropic molding machines, both of the barrels failed. Upon an analysis of the failed barrels by the present inventors, it was unexpectedly discovered that the barrels failed as a result of thermal stress and more particularly thermal shock in the cold section or end of the barrels. As used herein, the cold section or end of a barrel is that section or end where the material first enters into the barrel. It is in this section that the most intense thermal gradients are seen, particularly in the intermediate temperature region of the cold section, which is located downstream of the feed throat.

During use of a thixotropic material molding machine, the solid state material feed stock, which has been seen in pellet and chip forms, is fed into the barrel while at ambient temperatures, approximately 75° F. Being long and thick, the barrels of these thixotropic material molding machines are, by their very nature, thermally inefficient for heating a material introduced therein. With the influx of "cold" feed stock, the intermediate temperature region of the barrel is significantly cooled on its interior surface. The exterior surface of this region, however, is not substantially affected or cooled by the feed stock because the positioning of the heaters is directly thereabout. A significant thermal gradient, measured across the barrel's thickness, is resultingly induced in this region of the barrel. Likewise, a thermal gradient is also induced along the barrel's length. In this intermediate temperature region of the barrel where the highest thermal gradient has been found to develop, the barrel is heated more intensely as the heaters cycle "off" less frequently.

Within the barrel, a screw rotates, shearing the feed stock and moving it longitudinally through the various heating zones of the barrel causing the feed stock's temperature to rise and equilibriate at the desired level when it reaches the hot or shot end of the barrel. At the hot section of the barrel, the processed material exhibits temperatures generally in the range of 1050°–1100° F. The maximum temperatures subjected to the barrel are in the range of 1140° F. for magnesium processing. As the feed stock is heated into a semisolid state where it develops its thixotropic properties, the interior surface of the barrel correspondingly sees a rise in its temperature. This rise in interior surface temperatures occurs along the entire length of the barrel, including the cold section when its extent is lesser.

Once a sufficient amount of material is accumulated in the hot section of the barrel and the material exhibits its thixotropic properties, the material is injected into a die cavity having a shape conforming to the shape of the desired article of manufacture. Additional feed stock is then introduced into the cold section of the barrel, again lowering the temperature of the interior barrel surface, upon the ejection of the material from the barrel.

As the above discussion demonstrates, the interior surface of the barrel, particularly in the intermediate temperature region of the barrel, experiences a cycling of its temperature during operation of the thixotropic material molding machine. This thermal gradient between the interior and exterior surfaces of the barrel has been seen to be as great as 350° C.

Since the nickel content of the alloy 718 is subject to be corroded by molten magnesium, currently the most commonly used thixotropic material, barrels have been lined with a sleeve or liner of a magnesium resistant material to prevent the magnesium from attacking the alloy 718. Several such materials are Stellite 12 (nominally 30Cr, 8.3W and 1.4C; Stoody-Doloro-Stellite Corp.), PM 0.80 alloy (nominally 0.8C, 27.81Cr, 4.11W and bal. Co. with 0.66N) and Nb-based alloys (such as Nb-30Ti-20W). Obviously, the coefficients of expansion of the barrel and the liner must be compatible to one another for proper working of the machine.

Because of the significant cycling of the thermal gradient in the barrel, the barrel experiences thermal fatigue and shock. This was found by the present inventors to cause cracking in the barrel and in the barrel liner. Once the barrel liner has become cracked, magnesium can penetrate the liner and attack the barrel. Both the cracking of the barrel and the attacking of the barrel by magnesium were found to have contributed to the premature failure of the above mentioned barrels.

From the above it is evident that there exists a need for an improved barrel construction, particularly for those large thermal mass barrels of large capacity thixotropic material molding machines.

It is therefore a principle object of the present invention to fulfill that need by providing for an improved barrel construction as well as an improved construction for a thixotropic material molding machine itself.

Another object of the present invention is to provide a barrel construction having improved working life under the above operating conditions.

A further object of the present invention is to provide a barrel construction that is not susceptible to thermal fatigue and shock under the above mentioned operation conditions.

It is also an object of this invention to provide a barrel construction which is less expensive than previously known constructions and which incorporates more readily available materials.

Still another object of this invention is to provide a novel method for producing materials exhibiting thixotropic properties.

Also an object of this invention is to optimize the heat transfer and throughput of the thixotropic molding machine.

Another object of this invention is to decrease heat transfer through the nozzle of the machine to the sprue bushing.

Still another object of this invention is to increase heat transfer from the sprue through the sprue bushing.

SUMMARY OF THE INVENTION

The above and other objects are accomplished in the present invention by providing a novel barrel, nozzle, sprue bushing and heating.

One aspect of the present invention is a composite or a three-piece or three-part barrel construction where one part of the barrel is designed for preparation of the material and the other two-parts of the barrel are designed for shot requirements. These three barrel sections can generally be referred to as the cold, hot and outlet nozzle sections of the barrel. The cold and hot sections of a barrel according to the present invention are constructed differently, of different materials and joined together generally in a central portion of the barrel. The hot section remains constructed of a thick (and therefore high hoop strength), thermal fatigue resistant, creep resistant, and thermal shock resistant material, such as alloy 718 because temperature control is critical. A preferred configuration of the hot section is to use cast fine grain alloy 718 with a HIPPED in lining of an Nb-based alloy, such as Nb-30Ti-20W, for lower cost and better resistance from attack by the material being processed. Such materials may include aluminum and magnesium. Temperature control of the outlet nozzle, which is coupled to the hot section of the barrel, is also critical due to heat transfer between the nozzle and the die. After molding an article, it is important to form a solid plug in the nozzle and the plug must be adequately that excessive pre seal, but not so large (long) that excessive pressures are required to clear the plug from the nozzle passageway during the next cycle. Excessive pressure in clearing the plug can result in flashing of the die when the plug is blown or forced into the sprue spreader catcher cavity and blow by (reverse flow or leakage of SSM material through the non-return valve) will occur. A nozzle plug of an unacceptable size will form when the temperature of the nozzle drops too low. This can be a result of long cycle times allowing excessive heat flow into the die and cooling of the nozzle and/or the processing with higher temperature profiles in which heat flow into the die is not balanced against heat flow into the nozzle.

The above nozzle problem can be avoided by using a sprue break operating mode, which is a decoupling of the nozzle from the sprue after each shot. However, an aspect of the present invention has found it preferable to fabricate a sprue bushing insert for the tool that provides an insulating barrier between the nozzle and the die. The sprue bushing insert was unexpectedly found to reduce the pressure rise seen at the nozzle thereby obviating the need for a sprue break operation mode and reducing flash. The sprue break mode also adds several seconds to the cycle time of the machine.

Unlike prior constructions, the cold section of the barrel is constructed with a thinner (and therefore lower hoop strength) section of a second material. The second material, which may also be lower in cost than the first material, exhibits improved thermal conductivity and has a decreased coefficient of thermal expansion relative to the first material. The second material also exhibits good wear and corrosion resistance to the thixotropic material intended to be processed. Several preferred materials for the cold section of the barrel are stainless steel 422, T-2888 alloy, and alloy 909, which may be lined with an Nb-based alloy (such as Nb-30Ti-20W) and in turn nitrided, or borided or siliconized for the processing of aluminum and magnesium.

Another aspect of the thermally efficient machine is to use cooling of the sprue bushing to shorten cycle times and increase machine throughput.

Another aspect of the invention is the ability to eliminate use of a liner in the cold section of the barrel. As mentioned above, a liner is used in prior constructions to prevent the semisolid, or more specifically the molten phase of the semisolid magnesium from attacking the barrel material. In actuality, the magnesium attacks the nickel contained in the alloy 718. In stainless steel 422 the nickel content is less than 1% so reaction with magnesium is lessened to a negligible amount. Additionally, stainless steel 422 is a hardenable martensitic stainless steel with 0.2% carbon. By quenching at 1900° F. and tempering at 1200° F., the stainless steel 422 can be hardened to 35 Rockwell C ($R_c$). Additionally the interior surface of the passageway within the cold section of the barrel may be nitrided, thereby further providing good wear resistance in the high wear environment of the barrel. This allows the cold section of the barrel to be operated without a liner as was previously required. In situations where aluminum is to be processed, a liner as mentioned above is required and may be nitrided, borided or siliconized.

Another modified barrel construction which decreases the required thermal load on the barrel is one where a fiber-reinforced composite is substituted for the outer portion of the barrel, particularly in the cold section of the barrel. The fiber-reinforced composite is positioned outboard of a refractory insulation layer and a liner. Heating coils or other heating means are positioned about the fiber-reinforced composite. The hot section of the barrel remains constructed as previously mentioned.

In another aspect of the present invention, temperature control of the barrel is based on the temperature gradient as measured between the interior and exterior surfaces of the barrel. This is contrary to prior approaches where the temperature of the barrel was monitored near the interior surface of the barrel. Previously, temperature probes were provided within the barrel locations near the barrel's interior surface to monitor the interior surface temperatures. In the present invention, probes are not only located near the interior surface of the barrel, but also near the exterior surface of the barrel. In this manner three temperature readings can be monitored: 1) an interior surface temperature; 2) an exterior temperature; and 3) a thermal gradient temperature or $\Delta T$ through the barrel's thickness being the difference between the measurements of the internal and external probes. By monitoring the thermal gradient experienced by the barrel and adjusting the temperature accordingly, more precise temperature control of the processing of the thixotropic material can be performed and barrel failure, as a result of thermal fatigue and shock can be avoided. Monitoring only the interior surface temperature does not allow control over or monitoring for the above thermal conditions.

Yet another aspect of the present invention is the incorporation of the preheating of the solid state feed stock into the apparatus and method of forming thixotropic material. Preheating is preferably done after the feed stock has entered into the protective atmosphere of the apparatus and before the feed stock has entered into the barrel. Preheating is also only done to raise the temperature of the feed stock up to approximately 700–800° F. Preheating beyond this temperature range begins to melt the feed stock and therefore needs to be avoided. This is done to ensure the introduction of good shear into the material for the development of its thixotropic properties.

Preheating can be achieved in a variety of ways. One method is to preheat the feed stock as it passes through a transfer conduit coupled to the inlet of the barrel. Such heating can be achieved by the microwave heating of the feed stock as it passes through the transfer conduit. Alternatively, the feed stock can be preheated as it is being transferred by a transfer auger from the feed hopper to the transfer conduit. Yet another alternative would be to preheat the feed stock while it is still in the feed hopper. Heating of the feed stock can be done in numerous ways including, but are not limited to microwave heating, the use of band heaters, the use of infrared heaters or the use of heating tubes or flues which circulate a hot fluid, liquid or gas, from a fluid source.

In yet another aspect of the invention, the construction at the hot section of the barrel has been modified to reduce the stresses imposed on the seals, bolts, and bolt holes. This is generally achieved by moving the seals and bolts to a lower pressure region, located behind or upstream of the non-return valve associated with the screw and located within the barrel.

In another aspect of the invention, the construction of the thixotropic molding machine is such that the low-pressure cold section (that prepares the thixotropic slurry) is connected to a separate, hot or high pressure shot barrel or cylinder that itself imparts the high velocity shot. In such a two-stage construction, the processing or cold section of the thixotropic molding machine maximizes heat transfer to the feed stock to produce the slurry and then feeds the slurry into the shot or hot section which is of a construction to maximize strength during injecting of the material into the die. Alternatively, multiple low-pressure cold sections could be used to feed material into one shot or hot section. Such a construction is beneficial for higher capacity machines, those with a large shot or hot section.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENTS

Figure 1:
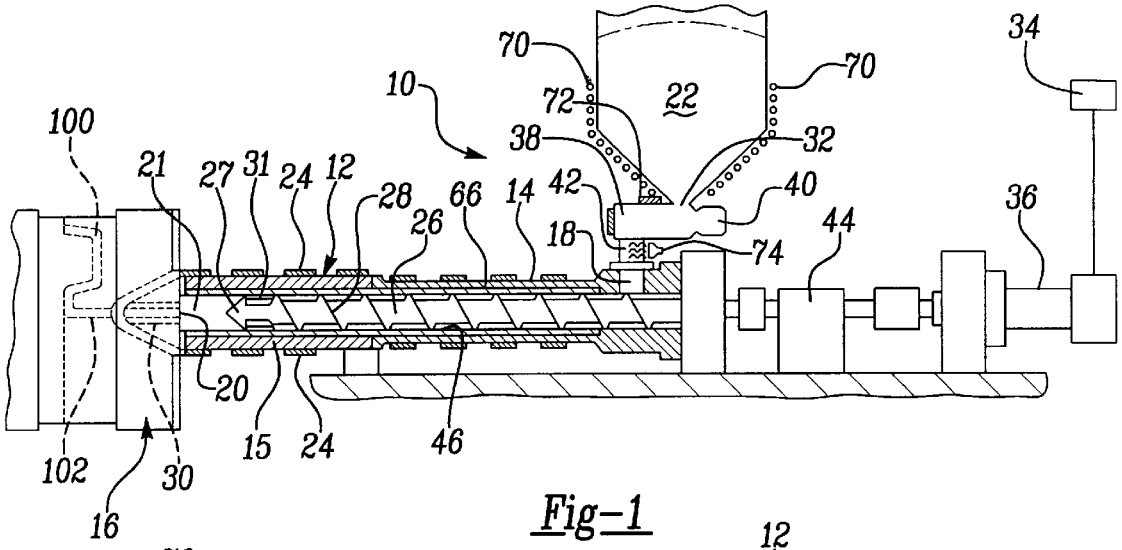
FIG. 1 is a general diagrammatic illustration of a thixotropic material molding machine according to the principals of the present invention.

Referring now to the drawings, a machine or apparatus for processing a metal material into a thixotropic state and molding the material to form molded, die cast, or forged articles according to the present invention is generally illustrated in FIG. 1 and designated at 10. Unlike typical die casting and forging machines, the present invention is adapted to use a solid state feed stock of a metal or metal alloy (hereinafter just "alloy"). This eliminates the use of a melting furnace in die casting or forging processes along with the limitations associated therewith. The present invention is illustrated as accepting feed stock in a chipped or pelletized form and these forms are preferred. The apparatus 10 transforms the solid state feed stock into a semisolid, thixotropic slurry which is then formed into an article of manufacture by either injection molding, die casting or forging.

It is anticipated that articles formed in the apparatus of the present invention will exhibit a considerably lower defect rate and lower porosity than non-thixotropically molded or conventional die cast articles. It is well known that by decreasing porosity the strength and ductility of the article can be increased. Obviously, any reduction in casting defects as well as any decrease in porosity is seen as being desirable.

The apparatus 10, which is only generally shown in FIG. 1, includes a barrel 12 coupled to a mold 16. As more fully discussed below, the barrel 12 includes a cold section or inlet section 14 and a hot section or shot section 15 and an outlet nozzle 30. An inlet 18 located in the cold section 14 and an outlet 20 located in the hot section 15. The inlet 18 is adapted to receive the alloy feed stock (shown in phantom) in a solid particulate, pelletized or chip form from a feeder 22. Preferably the feed stock is provided in the chip form and is of a size within the range of 4–20 mesh.

One group of alloys which are suitable for use in the apparatus 10 of the present invention includes magnesium alloys. However, the present invention should not be interpreted as being so limited since it is believed that any metal or metal alloy which is capable of being processed into a thixotropic state will find utility with the present invention, in particular Al, Zn, Ti and Cu based alloys.

At the bottom of the feed hopper 22, the feed stock is gravitationally discharged through an outlet 32 into a volumetric feeder 38. A feed auger (not shown) is located within the feeder 38 and is rotationally driven by a suitable drive mechanism 40, such as an electric motor. Rotation of the auger within the feeder 38 advances the feed stock at a predetermined rate for delivery into the barrel 12 through a transfer conduit or feed throat 42 and the inlet 18.

Once received in the barrel 12, heating elements 24 heat the feed stock to a predetermined temperature so that the material is brought into its two phase region. In this two phase region, the temperature of the feed stock in the barrel 12 is between the solidus and liquidus temperatures of the alloy, partially melts and is in an equilibrium state having both solid and liquid phases.

The temperature control can be provided with various types of heating or cooling elements 24 in order to achieve this intended purpose. As illustrated, heating/cooling elements 24 are representatively shown in FIG. 1 and consist of resistance band heaters. An induction heating coil may be used in an alternate configuration. The band resistance heaters 24 are preferred in that they are more stable in operation, less expensive to obtain and operate and do not unduly limit heating rates or capacity, including cycle times.

An insulative layer or blanket (not shown) may be custom fitted over the heating elements 24 to further facilitate heat transfer into the barrel 12. To further minimize heat/gain losses to the surroundings, a housing (not shown) can be positioned exteriorly about the length of the barrel 12.

Temperature control means in the form of band heaters 24 is further placed about the nozzle 30 (as illustrated in connection with FIGS. 4–6) to aid in controlling its temperature and readily permit the formation of a critically sized solid plug of the alloy. The plug prevents the drooling of the alloy or the back flowing of air (oxygen) or other contaminant into the protective internal atmosphere (typically argon) of the apparatus 10. Such a plug also facilitates evacuation of the mold 16 when desired, e.g. for vacuum assisted molding.

The apparatus may also include a stationary platen and a movable platen, each having respectively attached thereto a stationary mold half 16 and a moveable mold half. Mold halves include interior surfaces which combine to define a mold cavity 100 in the shape of the article being molded. Connecting the mold cavity 100 to the nozzle 30 are a runner, gate and sprue, generally designated at 102. Operation of the mold 16 is conventional and therefore is not being described in greater detail herein.

A reciprocating screw 26 is positioned in the barrel 12 and is rotated like the auger located within the feed cylinder 38 by an appropriate drive mechanism 44, such as an electric motor, so that vanes 28 on the screw 26 subject the alloy to shearing forces and move the alloy through the barrel 12 toward the outlet 20. The shearing action conditions the alloy into a thixotropic slurry consisting of spherulrites of rounded degenerate dendritic structures surrounded by a liquid phase.

During operation of the apparatus 10, the heaters 24 are turned on to thoroughly heat the barrel 12 to the proper temperature or temperature profile along its length. Generally, for forming thin section parts, a high temperature profile is desired, for forming mixed thin and thick section parts a medium temperature profile is desired and for forming thick section parts a low temperature profile is desired. Once thoroughly heated, the system controller 34 then actuates the drive mechanism 40 of the feeder 38 causing the auger within the feeder 38 to rotate. This auger conveys the feed stock from the feed hopper 22 to the feed throat 42 and into the barrel 12 through its inlet 18. If desired, preheating of the feed stock is performed in either the feed hopper 22, feeder 38 or feed throat 42 as described further below.

In the barrel 12, the feed stock is engaged by the rotating screw 26 which is being rotated by the drive mechanism 44 that was actuated by the controller 34. Within the bore 46 of the barrel 12, the feed stock is conveyed and subjected to shearing by the vanes 28 on the screw 26. As the feed stock passes through the barrel 12, heat supplied by the heaters 24 and the shearing action raises the temperature of the feed stock to the desired temperature between its solidus and liquidus temperatures. In this temperature range, the solid state feed stock is transformed into a semisolid state comprised of the liquid phase of some of its constituents in which is disposed a solid phase of the remainder of its constituents. The rotation of the screw 26 and vanes 28 continues to induce shear into the semisolid alloy at a rate sufficient to prevent dendritic growth with respect to the solid particles thereby creating a thixotropic slurry.

The slurry is advanced through the barrel 12 until an appropriate amount of the slurry has collected in the fore section 21 (accumulation region) of the barrel 12, beyond the tip 27 of the screw 26. The screw rotation is interrupted by the controller 34 which then signals an actuator 36 to advance the screw 26 and force the alloy through a nozzle 30 associated with the outlet 20 and into the mold 16. The screw 26 is initially accelerated to a velocity of approximately 1 to 5 inches/second. A non-return valve 31 prevents the material from flowing rearward toward the inlet 18 during advancement of the screw 26. This compacts the shot charge in the fore section 21 of the barrel 12. The relatively slow speed permits compaction and squeezes or forces excess gas, including the protective gas of the atmosphere, out of the charge of slurry. Immediately upon compacting the charge, the velocity of the screw 26 is rapidly increased raising the pressure to a level sufficient to blow or force the plug from the nozzle 30 into a sprue cavity designed to catch it. As the instantaneous pressure drops, the velocity increases to a programmed level, typically in the range of 40 to 120 inches/second in the case of magnesium alloys. When the screw 26 reaches the position corresponding to a full mold cavity, the pressure again begins to rise at which time the controller 34 ceases advancement of the screw 26 and begins retraction at which time it resumes rotation and processing of the next charge for molding. The controller 34 permits a wide choice of velocity profiles in which the pressure/velocity relationship can be varied by position during the shot cycle (which may be as short as 25 milliseconds or as long as 200 milliseconds).

Once the screw 26 stops advancing and the mold is filled, a portion of the material located within the nozzle 30 at its tip solidifies as a solid plug. The plug seals the interior of barrel 12 and allows the mold 16 to be opened for removal of the molded article.

During molding of the next article, advancement of the screw 26 will cause the plug to be forced out of the nozzle 30 and into the sprue cavity which is designed to catch and receive the plug without interfering with the flowing of the slurry through the gate and runner system 102 into the mold cavity 100. After molding, the plug is retained with the solidified material of the gate and runner system 102, trimmed from the article during a subsequent trimming step and returned to recycling.

Temperature control of the nozzle 30 is critical due to heat transfer between the nozzle 30 and the die 16. After molding an article, it is important to form a solid plug in the nozzle which is adequate to provide a seal but not so large (long) that excessive pressures are required to clear the plug from the passageway during the next cycle. Excessive pressure in clearing the plug can result in flashing (extra material at the die parting line as a result of a slight separating of the die) of the die, as the plug is blown or forced into the sprue spreader catcher cavity, and blow by (reverse flow or leakage of SSM material through the non-return valve). A nozzle plug of an unacceptable size forms when the temperature of the nozzle 30 drops too low. This can be a result of long cycle times allowing excessive heat flow into the die and cooling of the nozzle 30 and/or of excessive thermal conduction through the nozzle/bushing junction in which heat flow into the die is not balanced against heat flow into the nozzle 30.

Figure 5:
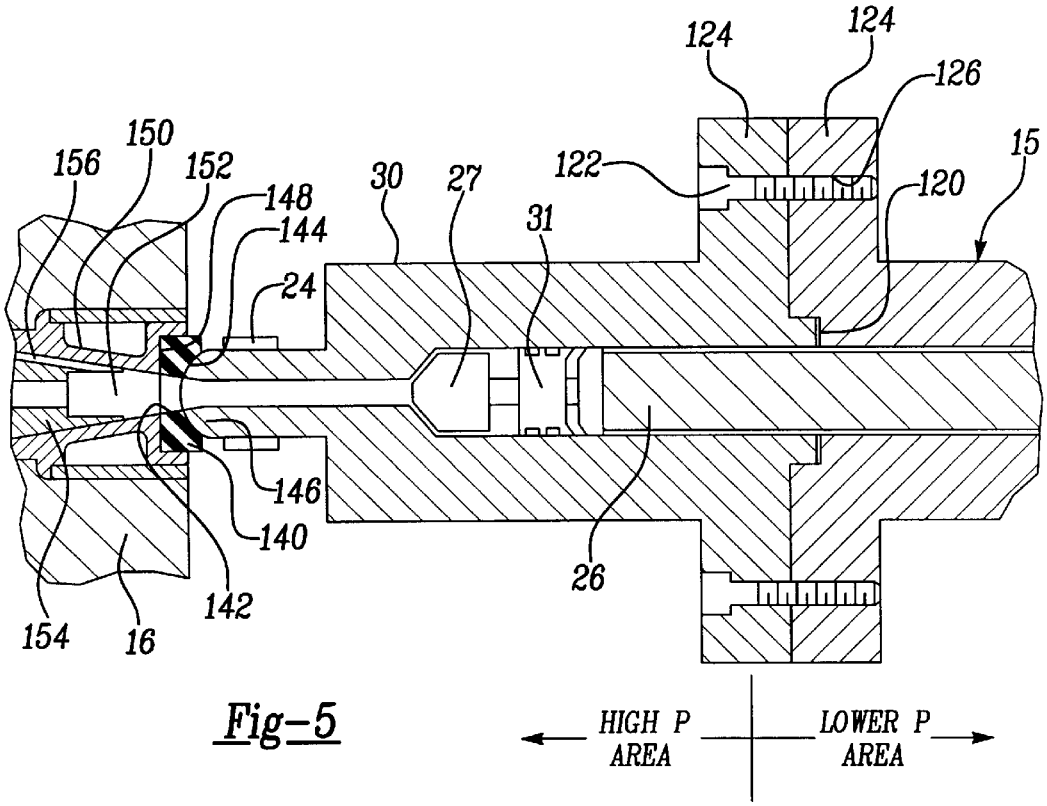
FIG. 5 is an enlarged sectional view of the hot section of a barrel according to another aspect of the present invention.

The above nozzle problem is avoided by fabricating a sprue bushing insert 140 that provides an insulating barrier between the nozzle 30 and the die 16 and by fabricating the nozzle 30 from a material exhibiting reduced thermal conductivity. The sprue bushing insert 140 is generally annular defining a central opening 142 and is contoured on one side, designated at 144, to receive the tip 146 of the nozzle 30. The sprue bushing insert 140, as seen in FIG. 5, is received within an annular seat 148 defined in a bushing 150 which is itself received in the die 16. The bushing 150 includes portions defining a central area 152 into which a plug catcher 154 is received for "catching" a cleared plug. A sprue passageway 156 is cooperatively defined between the bushing 150 and the catcher 152.

A sprue bushing insert 140 fabricated from 0.8% C PM Co alloy as outlined above was unexpectedly found to reduce the pressure rise seen at the nozzle by 50% (from 6000 psi to 3000–4000 psi) thereby reducing flash and obviating the need for a sprue break operation mode. Plasma spraying of the downstream face and periphery of the nozzle bushing insert 140, with cubic stabilized $ZrO_2$, further reduced heat transfer and reduced the pressure spike. If kept in compression, cubic stabilized zirconia inserts may be used. Other heat resistant low conductivity materials may serve the same purpose.

For the nozzle 30 itself, materials of construction are alloy steel (such as T-2888), PM 0.8C alloys, and Nb-based alloys, such as Nb-30Ti-20W. In one preferred construction, the nozzle 30 is monolithically formed of one of the above alloys. In another preferred embodiment, the nozzle 30 is formed of alloy 718 and HIPPED to provide it with a resistant surface of an Nb-base alloy or PM 0.8C alloy.

The sprue bushing 150 of FIG. 5 may be further cooled to speed the solidification of the sprue, thereby shortening the cycle time and increasing machine throughput. On a 0.62 lb. shot, cycle time was reduced from 28 to 24 seconds. Further cycle time reduction can be gained by independent cooling of the sprue without effecting machine nozzle or plug size.

The barrel 12 of the present apparatus 10 differs from prior constructions in that the present barrel 12 is provided with a three-piece construction. Prior barrels have only been seen in a monolithic construction, either with or without liners. As discussed above, in large capacity machines, such as 600 ton machines, such monolithic barrels are expensive, take a significant amount of time to procure, and have failed prematurely in operation due to what has been determined to be thermal fatigue and shock. The barrel 12 of the present invention overcomes all three of the above drawbacks.

Figure 2:
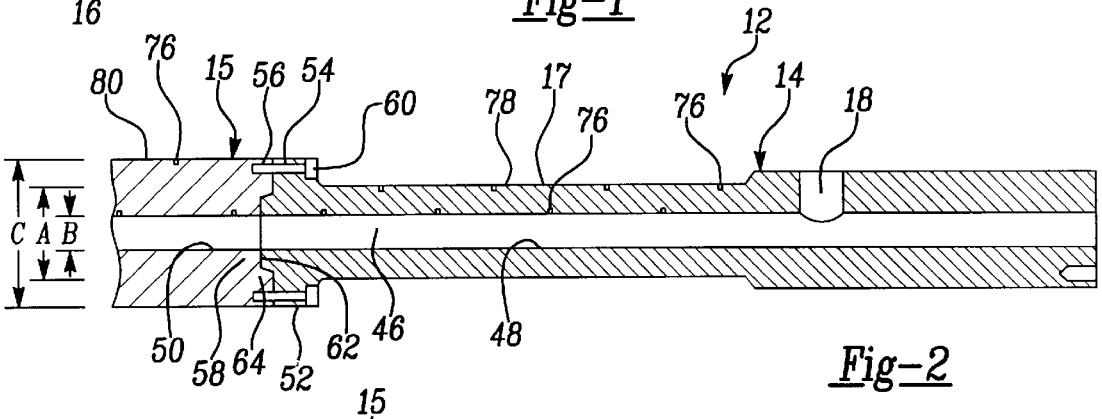
FIG. 2 is an enlarged sectional view illustrating another embodiment of the barrel of the molding machine seen in FIG. 1.

As best seen in FIGS. 1 and 2, the barrel 12 of the present invention includes three sections which are readily referred to as the cold section 14, hot section 15 and the nozzle 30 of the barrel 12. As readily seen in FIG. 2, the cold section 14 of the barrel 12 is adapted to matingly engage the hot section 15 so that a continuous bore 46 is cooperatively defined by the interior surfaces 48, 50 respectively of the cold section 14 and hot section 15. To secure the two barrel sections 14, 15 together, the cold section 15 is provided with a radial flange 52 in which are defined mounting bores 54. Corresponding threaded bores are defined in the mating section 58 of the barrel's hot section 15. Threaded fasteners 60, inserted through the bores 54 in the flange 52, threadably engage the threaded bores 56 thereby securing the hot and cold sections 14, 15 together. To promote engagement of the sections 14, 15, the hot and cold sections 14, 15 are complimentary shaped with the cold section 14 being formed with a male protuberance 62 and the hot section 15 being formed with a female recess 64.

The barrel 12 of the present invention overcomes the drawbacks of the prior art by minimizing the thermal gradient experienced through its thickness and along its length. One contributing factor in minimizing the experienced thermal gradient is that the cold section 14 of the barrel 12, including the intermediate heating zone 17 for the barrel 12, is constructed of a material which differs from the material used to construct the hot section 15. The hot section 15 itself is constructed from alloy 718 and this alloy with its high yield strength provides significant hoop strength to the hot section, the location where hoop strength is one of the primary concerns. The cold section 14, however, does not require the same hoop strength capabilities as the hot section 15 since pressures in this section are less during molding. The cold section 14 therefore exhibits a reduced diameter or wall thickness over a significant portion of its length relative to the hot section 15. Since the hoop strength of a given shape generally increases, as mentioned above, with its thickness, the diameter A of the cold section 14 and its wall thickness (the diameter B of the bore 46 subtracted from the diameter A of the cold section 14 and divided in half) can be significantly thinner than the wall thickness (diameter B subtracted from diameter C and divided in half of the hot section 15. Illustratively, for the barrel 12 of the 600 ton apparatus 10, diameter A is 7.5 inches, diameter B is 3.5 inches, and diameter C is 10.875 inches, the wall thickness therefore being two inches for the-cold section 14 and 3.662 inches for the hot section 15.

The material forming the cold section 14 of the barrel 12 also preferably exhibits an increased thermal conductivity and a decreased thermal coefficient of expansion (TCE) than that of the material forming the hot section 15. It is further preferred that the material forming the cold section 14 of the barrel 12 be readily available and offer a cost advantage over the material forming the hot section 15 of the barrel 12. In this way, the overall cost of the barrel 12 will be reduced. A preferred material is stainless steel 422. Stainless steel 422 has a TCE of $11.9\times10^{-6}$/°C. and a thermal conductivity of 190 Btu/in/ft$^2$/hr/°F. as compared to the alloy 718's TCE of $14.4\times10^{-6}$/°C. and its thermal conductivity of 135 Btu/in/ft$^2$/hr/° F. Stainless steel 422 is also readily available at a cost of $3.20 per pound compared to alloy 718's scarcity (a delivery time of approximately 12 months) and a cost of approximately $12.00 per pound.

As seen in FIG. 2, the passageway or bore 48 of the barrel 12 is provided without a liner while the barrel 12 in FIG. 1 is provided with a liner 66 as an alternative embodiment. The liner 66 in FIG. 1 is shrunk fit to a predetermined interference fit within the barrel 12 and is constructed of a material which is resistant to attack by the alloy being processed in the apparatus 10. Where a magnesium alloy is the processed material, a cobalt-chromium alloy for the liner 66 may be employed to prevent the magnesium from attacking the nickel content of the barrel. However, since the cold section 14 of the barrel has a low nickel content and the processed alloy does not have a significant residence time within the cold section 14, it is possible to operate the apparatus 10 without a liner in the cold section such that only negligible corrosion occurs in the cold section 14. To further reduce the effects of corrosion as well as wear in the cold section 14, the cold section 14 is heat treated by quenching from 1,900° F. and tempering at 1200° F. thereby producing a surface hardness of 31–35 $R_c$. Additionally, the bore 48 may be nitrided to enhance its hardness and provide it with higher wear resistance.

When aluminum or zinc-aluminum alloys are being processed, it is believed that an Nb-based alloy (such as Nb-30Ti-20W and which may be nitrided, borided or siliconized) liner 66 should be employed in both sections 14, 15 of the barrel 12. Such an alloy has thermal coefficient of expansion (TCE) of $9\times10^{-6}$/°C. and high thermal conductivity of 320 Btu/in/ft$^2$/hr/° F. Thus, when it is HIPPED into alloys of higher TCE (such as 422 or fine grain alloy 718 ), the compression stresses generated during cooling and the high temperature conductivity make for extended service life. Intermediate stress relief annealing of the barrel 12 and liner 66 after shrink fitting may further be desirable and performed to stabilize dimensions.

Test data on the corrosion of Nb-30Ti-20W, Nb-30Ti-20W (nitrided) and Nb-30Ti-20W (siliconized), is presented below. Samples of the above materials were weighed and then attached as paddles to a stir rod. The rod as lowered into A356 alloy at 605–625° C. and rotated at 200 rpm. After the duration of the test, the samples were then removed from the A356 alloy and reweighed. Corrosion was then determined as a percent weight loss. The untreated Nb-30Ti-20W sample exhibited a 1.4% loss at forty-six hours and a 4.6% loss at ninety-six hours. For Nb-30Ti-20W (nitrided), the losses were 0.13% at twenty-four hours and 0.20% at ninety-six hours. For Nb-30Ti-20W (siliconized), the losses were 0.07% at twenty-four hours and 0.10% at ninety-six hours. Results similar to those for nitriding and siliconizing are expected for borided samples of Nb-30Ti-20W.

Figure 3:
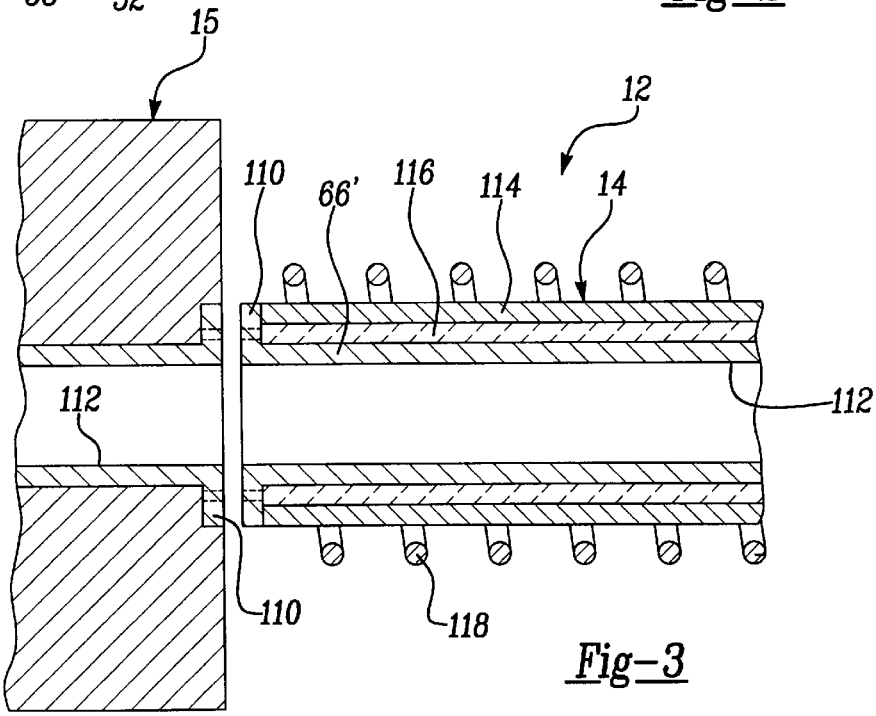
FIG. 3 is a sectional view illustrating the fiber-reinforced composite construction to one embodiment of the present invention.

An alternative embodiment of the barrel's cold section 14 is illustrated in the not scale drawing of FIG. 3. In this embodiment, which utilizes a two-piece liner 66' bolted through flanges 110 to define the internal bore 112, a reinforced carbon fiber composite outer portion 114 defines the cold section 14 of the barrel 12. Between the composite outer portion 114 and the liner 66' is positioned a layer 116 of a refractory type insulation material. Induction coils 118 or other suitable heating means are wound about the cold section 14 and may be specifically coupled to the liner 66' in order to provide a heat input into the cold section 14. Preferred materials for the reinforced fiber composite over portion 114 include all carbon fiber materials and wound filament materials, for example, graphite embedded within thermoset resin and carbon-carbon composites. Materials for the insulative layer 116 include a broad class of refractory materials as well as other materials having temperature and stress characteristics to withstand the previously mentioned operating conditions.

Figure 4:
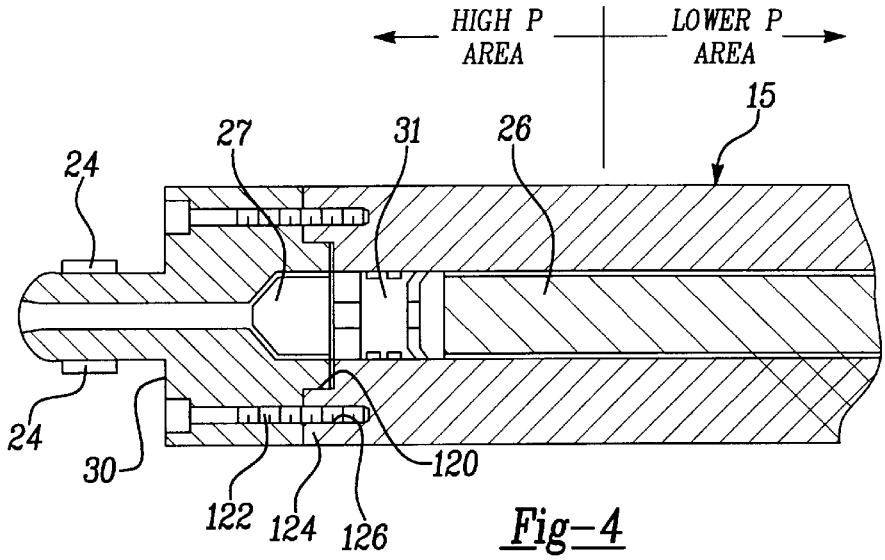
FIG. 4 is an enlarged sectional view of the construction of the hot-section of a barrel according to the known technology.

The present invention also includes an aspect which reduces the stresses imposed on the seals, bolts, bolt holes and flanges where the hot section 15 of the barrel 12 is secured to the nozzle 30. In prior constructions, as seen in FIG. 4, the tip 27 and non-return valve 31 of the screw 26 are located such that they are upstream of the seal 120 which is positioned between the nozzle 30 and the hot section 15. Similarly, the bolts 122, flanges 124 and mounting bores 126 utilized to secure the nozzle 30 to the hot section of the barrel 12 are also located downstream of the screw tip 27 and non-return valve 31. As a result, as the screw 26 is advanced to discharge the shot of material through the nozzle 30, the seal 120, bolts 122, flanges 124 and mounting bores 126 are all subjected to high pressures. Ruptured seals 120 are accordingly a possibility if this area is not properly serviced.

As seen in FIG. 5, the present invention overcomes the problems of the previously discussed seal 120 and related components being located in the high pressure area. This is achieved by increasing the axial length of the nozzle 30 and decreasing the length of the hot section 15 of the barrel 12, effectively shifting the location of the seal 120 and related components axially along the screw 26 to a position where they are in the low pressure region upstream of the non-return valve 31.

To mount the nozzle 30 to the hot section 15, flanges 124 are correspondingly formed on these components and appropriate bores 126 and bolts 122 located and threadably engaged therein. Alternatively, the nozzle 30 can be formed with a threaded portion to matingly engage a threaded portion of the hot section 15 or a threaded retainer ring can be used to matingly engage the hot section 15 and captively retain the nozzle 30 therewith.

An added benefit of this nozzle 30 construction is a reduction in barrel cost due to decreased usage of the barrel material.

To further decrease the effects of thermal fatigue and thermal shock, the apparatus 10 of the present invention provides for the preheating of the feed stock, as seen in FIG. 1. Preferably the feed stock is only heated to temperatures of 600° F. for magnesium and 700–800° F. for aluminum, which is below the melting point temperature of the alloy's constituents. Alternative materials are similarly heated. In this manner, the feed stock is still provided into the barrel 12 in a solid state allowing for the development of good shear by the screw 26 as the alloy starts to melt within the barrel 12.

Various methods can be used to preheat the feed stock. One such method would be to incorporate heating tubes 70 about and through the feed hopper 22. The heating tubes or flues 70 would carry a heated fluid or gas from a source. Alternatively, resistance heaters, induction heaters, infrared heaters and other heating type elements could be employed in place of the heating tube 70.

Instead of heating the feed stock in the feed hopper 22, heating could be caused to occur in the feeder 38 through the incorporation of band heaters 72, infrared heaters, heating tubes or flues 70 or other means. As yet another alternative, the feed stock can be heated as it passes through the transfer conduit or feed throat 42 and into the barrel 12. One method of accomplishing heating in the feed throat 42 is to provide the feed throat 42 as a glass tube and positioning a microwave source or reactor 74, of known design, adjacent to or therearound. As the feed stock passes down through the glass feed throat 42, the microwaves from the microwave source 74 preheat the feed stock via microwave heating. Such heating can readily be utilized to increase the temperature of the feed stock up to approximately 750° F. The following table illustrates the heating times and temperatures of various samples at various microwave power settings and demonstrates the effectiveness of this heating method.

| Sample | Wt. & atmosphere | Temp. obtained | Time | Power |
|---|---|---|---|---|
| Comalco Al | 67 g (Ar) | 300° F. | 4.5 min. | 220 W |
| Comalco Al | 67 g (Ar) | 364° F. | 5.5 min. | 220 W |
| Comalco Al | 67 g (Ar) | 730° F. | 3 min. | 508 W |
| Comalco Al | 67 g (air) | 754° F. | 6.45–9 min. | 500 W |
| ACuZn5 | ~200 g (Ar) | 212° F. | 1.5 min. | 220 W |
| ACuZn5 | ~200 g (Ar) | 460° F. | 3 min. | 220 W |

(Comalco Al: Comalco Aluminum Ltd., Melborne, Australia; "ACuZn5": trade name "Accuzinc 5", General Motors Corporation)

In order to monitor the temperature gradient across the barrel 12, temperature probes 76, thermocouples, are positioned adjacent to the interior surfaces 48, 50 of the barrel 12 and adjacent to the exterior surfaces 78, 80 as seen in FIG. 2. By utilizing the controller 34 to monitor the temperature gradient through the barrel via the difference between the probe measurements, the heaters 24 can be more precisely controlled by the controller as to their output to minimize the effects of thermal cycling on the barrel 12 which results from the influx of the feed stock (preheated or at ambient temperatures) into the cold section 14.

Figure 6:
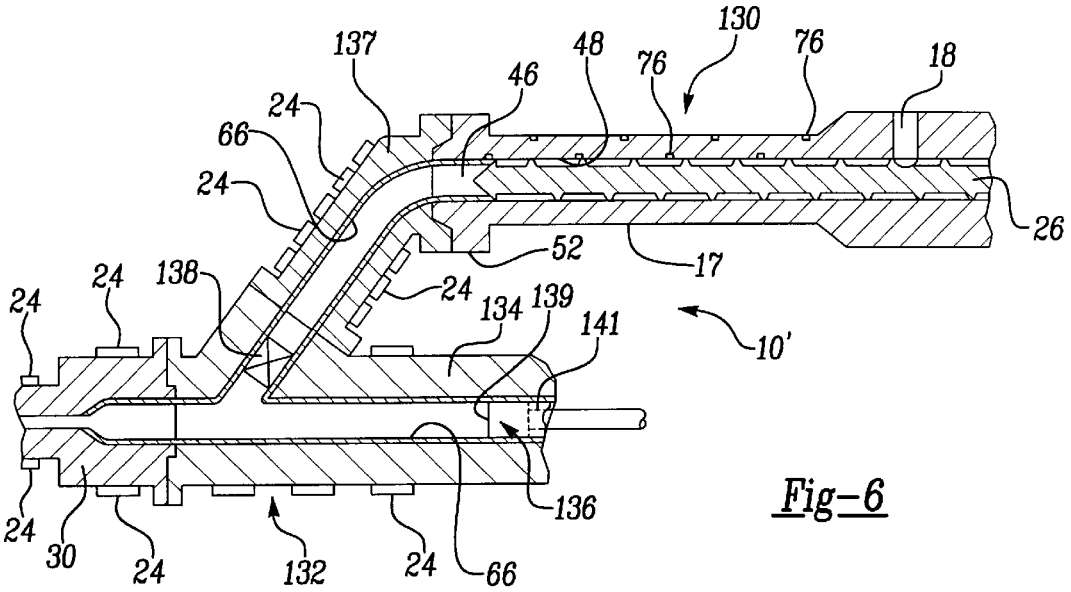
FIG. 6 is a general diagrammatic illustration of a two-stage (processing and injecting) machine according to another aspect of the present invention.

As an alternative embodiment for the apparatus 10' of the present invention, a two-stage apparatus 10' is herein disclosed and illustrated in FIG. 6. The first stage 130 of this apparatus 10' is designed to optimize the heat transfer and shear imparted into the feed stock so as to prepare or process the material into a molten or semi-solid state. In the first stage 130, the various components of the apparatus 10' are subjected to high temperatures, low pressures, and low material transfer velocities as the screw 26 subjects the material to shear and longitudinally moves or pumps the material. As seen in FIG. 6, the first stage 130 comprises a cold section 14 of the barrel, similar to that seen in FIG. 2. Accordingly, the like elements are designated with like references.

From the first stage 130, a second stage 132 of the apparatus 10', which includes a shot sleeve 134 and piston 136 having a piston face 139, receives the processed semi-solid material through a transfer coupling 137 and a valve 138. In this second stage 132, the shot sleeve 134 and other components of the apparatus 10' are subjected to the high pressure and high velocity resulting from movement of the piston 136 and piston face 141 to inject the material through a nozzle 30 and into a mold (not shown).

A shroud 141 extends off of the piston 136 away from the piston face 139. The shroud 141 operates to inhibit material being processed from dropping behind the piston 136, out of the transfer coupling 137. Materials for forming the piston 136, piston face 139 and shroud preferably include, for the reasons mentioned elsewhere, Nb-based alloys (including Nb-30Ti-20W), 0.8C PM alloy and similar materials, in either a monolithic or surfaced construction.

The second stage 132, usually, but not necessarily, requires heat input from heaters 24. Precise temperature in the second stage 132 is necessary so that heat transfer between the nozzle 30 (not shown in FIG. 6) and the die 16 (not shown in FIG. 6) will result in the proper formation of a plug in the nozzle. Since temperature control at the nozzle 30 was discussed above in connection with FIG. 5, reference is herein made to that section which is equally applicable to the present two-stage apparatus 10' and its second stage 132.

For the processing of the feed stock material, the first stage 130 can have a volume on the order of 20–30 times greater than the volume of the second stage 132. Since the first stage 130 is not subjected to the high pressures associated with the injection of the material into a mold, the barrel liner materials, if utilized, of the first stage 130 can be designed with lower strength requirements, higher conductivities and lower coefficients of thermal expansion. As a result of the present design, the components of the first stage 130 are subjected to lower thermal stresses and the production costs of the first stage 130 portion is reduced. The lower pressures and associated impacts in the first stage 130 of this design allow for the use of alternative materials in the construction of the first stage 130. For example, in the situation where aluminum is being processed, niobium based alloys (such as Nb-30Ti-20W) can be utilized in the formation of aluminum resistant liners 66 and various other components including the screw 26, non-return valve 138, rings, screw tip, and others. The construction of such components is described in co-pending patent application Ser. No. 08/658,945, filed May 31, 1996 and commonly assigned to the Assignee of the present application, the subject matter of which is hereby incorporated by reference. As a further alternative, the various components of the first stage 130 can be manufactured utilizing aluminum resistant ceramics and cermets. Previously, such ceramics and cermets were impractical as a result of the high pressures and stresses which would necessarily be imparted to them. Both of the above materials, the ceramics and the Nb-based allows, can be provided as surface layers over other less expensive materials or can be utilized to form monolithic components.

Figure 7:
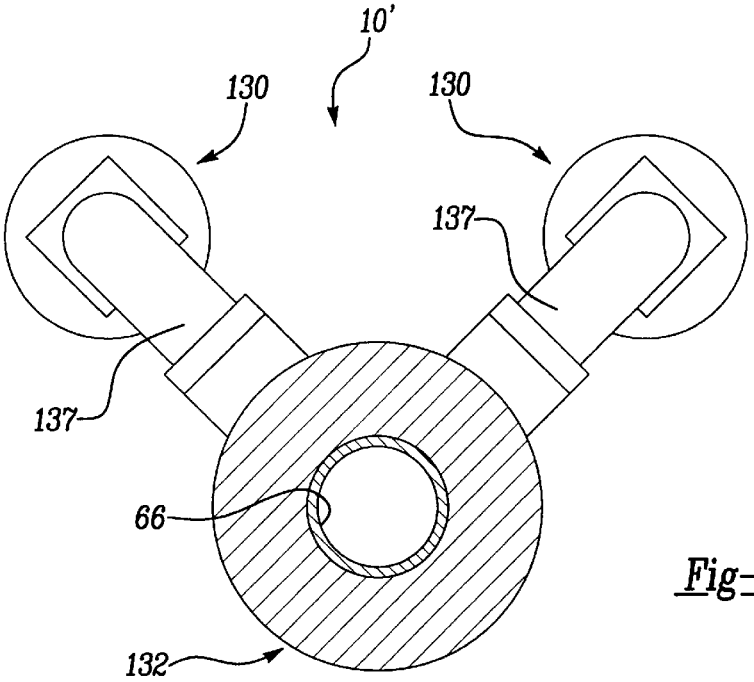
FIG. 7 is an end sectional view of another embodiment of a two-stage machine which has multiple extruders feeding into a common shot sleeve.

As seen in the embodiment of FIG. 7, the invention further details a two-stage apparatus 10' having multiple first stages 130 (only two being illustrated, but more being possible) which feed into a common second stage 132. As such, the embodiment allows for a larger capacity second stage 132 and decreased cycle times over previously discussed approaches. In all other material respects, the two-stage apparatus 10' is constructed as discussed in connection with FIG. 6.

In constructing either a two-stage apparatus 10' or a one-stage apparatus 10 as described above, reduced costs can be further achieved by manufacturing the various components with micro-grain casting or powder metallurgy (PM) techniques to form a net-shaped component of the super-alloy and then HIPPING a Nb-based alloy or cobalt-based alloy to the net-shaped component, thereby providing a finished part. Micro-grain casting or forming by PM techniques of net-shaped components will result in the net-shapes being more resistant to grain growth at the HIPPING temperatures, keeping grain size at approximately ASTM 5–6. Wrought super-alloys have exhibited grain growth to ASTM ØØ. By producing net-shape components by a micro-grain casting or a PM technique and then HIPPING the components, a reduction in machining costs is achieved. The finished net-shape components will have particular applicability for use as components in the hot section of a single stage apparatus 10 or in the second stage of a two-stage apparatus 10. Accordingly, such components could be used as the hot sections of a barrel, adapters between the hot section and the cold section of a barrel, transfer components on a two-stage apparatus, shot sleeves for the second stage in the two-stage apparatus as well as numerous other individual components.

The incorporation of the above aspects of the present invention allows for the production of a large capacity, 400 tons or greater, apparatus 10 or faster small capacity machines for processing and molding thixotropic materials without the drawbacks of the known prior systems. Through the incorporation of these features, an apparatus 10 is provided which will minimize the effects of thermal fatigue and stress thereby providing large capacity apparatus 10 having a long useful life. Total longitudinal stresses in the barrel 12 are also thereby reduced.

While the above description constitutes the preferred embodiment of the present invention, it will be appreciated that the invention is susceptible to modification, variation and change without departing from the proper scope and fair meaning of the accompanying claims.

We claim:

1. A two-stage apparatus for processing a metallic material feed stock into a molten or semisolid state, said apparatus comprising:

a first processing stage including a first barrel having opposing first and second ends, an interior surface defining a central passageway through said barrel, portions defining an inlet into said passageway and located toward said first end, portions defining an outlet out of said passageway and located toward said second end, said barrel being constructed of a first material of a first thermal conductivity optimizing heat transfer to the feed stock, a screw located within said passageway for rotation relative thereto, said screw including a body having at least one vane thereon, said vane at least partially defining a helix around said body to propel the feed stock through said barrel, drive means for rotating said screw and shearing the feed stock at a rate sufficient to inhibit complete formation of dendritic structures therein when the feed stock is in a semisolid state thereby processing the feed stock into a material in a thixotropic state, heating means for transferring heat through said barrel and into said feed stock such that the feed stock is heated to a temperature greater than a solidus temperature of at least one constituent of the feed stock;

a second stage including second barrel having a shot sleeve having opposing first and second ends, an interior surface defining a central passageway through said shot sleeve, inlet portions defining an inlet into said passageway and outlet portions defining an outlet out of said passageway and located toward said second end, said shot sleeve having a second thermal conductivity which is less than said first thermal conductivity and having increased strength and corrosion resistance over said first material such that strength and corrosion resistance are optimized in said shot sleeve over heat transfer, means for maintaining the material at generally 95–100% of a temperature at which the material is received thereinto;

discharge means for high pressure and high velocity discharging of the material from within said shot sleeve through a nozzle, said discharge means including a piston having a piston face and an actuator;

said nozzle coupled to said second end of said shot sleeve and including portions defining a nozzle passageway coincident with and corresponding to said central passageway of said shot sleeve;

a transfer coupling having a passageway defined therethrough, said coupling connected between said first barrel and said second barrel for transferring the material from said outlet of said first barrel to said inlet of said second barrel; and valve means for permitting one-way movement of the material therethrough.

2. The improvement set forth in claim 1 wherein said means for maintaining the material generally at a received temperature includes insulation located about said shot sleeve.

3. The improvement set forth in claim 1 wherein the nozzle is constructed of a third material having a third thermal conductivity which is less than said second thermal conductivity.

4. The improvement set forth in claim 1 wherein said first stage includes a plurality of barrels and transfer couplings, said barrels being coupled via said transfer couplings into said hot sleeve of said second stage.

5. The improvement set forth in claim 1 wherein at least one of said shot sleeve, transfer coupling, piston, piston face and nozzle is lined with an Nb-based alloy.

6. The improvement set forth in claim 5 wherein said alloy is Nb-30Ti-20W.

7. The improvement set forth in claim 5 wherein at least one of said shot sleeve, transfer coupling, piston, piston face and nozzle is lined with PM 0.8C alloy.

8. The improvement set forth in claim 1 wherein at least one of said shot sleeve, transfer coupling, piston, piston face and nozzle is lined with a nitrided material.

9. The improvement set forth in claim 1 wherein at least one of said shot sleeve, transfer coupling, piston, piston face and nozzle is lined with a borided material.

10. The improvement set forth in claim 1 wherein at least one of said shot sleeve, transfer coupling, piston, piston face and nozzle is lined with a siliconized material.

11. The improvement set forth in claim 1 wherein at least one of said shot sleeve, transfer coupling, piston, piston face and nozzle is constructed of fine grain cast alloy 718.

12. The improvement set forth in claim 11 wherein at least one of said shot sleeve, transfer coupling, piston, piston face and nozzle is lined with an Nb-based alloy.

13. The improvement set forth in claim 12 wherein said Nb-based alloy is Nb-30Ti-20W.

14. The improvement set forth in claim 1 wherein said valve means include a valve at least partially constructed of an Nb-based alloy.

15. The improvement set forth in claim 13 wherein said alloy is Nb-30Ti-20W.

16. The improvement set forth in claim 1 wherein said valve means includes a valve at least partially constructed of PM 0.8C alloy.

17. The improvement set forth in claim 1 wherein said piston includes a piston shroud extending rearward away from said piston face.

18. The improvement set forth in claim 17 wherein said piston shroud is of an Nb-based alloy.

19. The improvement set forth in claim 17 wherein said piston shroud is of Nb-30Ti-20W.

20. The improvement set forth in claim 17 wherein said piston shroud is of 0.8C PM alloy.

21. The improvement set forth in claim 1 wherein said means for maintaining the material generally at a received temperature includes heaters located about said shot sleeve.

22. The improvement as set forth in claim 1 wherein said first material is stainless steel 422.

23. The improvement as set forth in claim 1 wherein said first material is stainless steel T-2888.

* * * * *